United States Patent [19]

Sonnleitner et al.

[11] Patent Number: 5,011,086

[45] Date of Patent: Apr. 30, 1991

[54] SPRAY COATING DEVICE FOR ELECTRICALLY CONDUCTIVE COATING LIQUIDS

[75] Inventors: Adolf H. Sonnleitner, Offenbach; Karl H. Bergmann, Wacholderberg, both of Fed. Rep. of Germany

[73] Assignee: Ransburg Corporation, Indianapolis, Ind.

[21] Appl. No.: 438,495

[22] PCT Filed: Jun. 13, 1988

[86] PCT No.: PCT/US88/02107

§ 371 Date: Nov. 30, 1989

§ 102(e) Date: Nov. 30, 1989

[87] PCT Pub. No.: WO88/10152

PCT Pub. Date: Dec. 29, 1988

[30] Foreign Application Priority Data

Jun. 16, 1987 [DE] Fed. Rep. of Germany ..... 3720201
Mar. 15, 1988 [EP] European Pat. Off. ..... 88104055.4

[51] Int. Cl.[5] ..... B05B 5/00
[52] U.S. Cl. ..... 239/691
[58] Field of Search ..... 239/691

[56] References Cited

U.S. PATENT DOCUMENTS 3,393,662 7/1968 Blackwell .
3,764,068 10/1973 Lacchia .
4,114,810 9/1978 Masuda .
4,572,437 2/1986 Huber et al. .

FOREIGN PATENT DOCUMENTS 3600920 7/1987 Fed. Rep. of Germany .

*Primary Examiner*—Andres Kashnikow
*Assistant Examiner*—Lesley D. Morris
*Attorney, Agent, or Firm*—Barnes & Thornburg

[57] ABSTRACT

A spray coating device includes a ring (14) surrounding a spray device (4) radially spaced and supporting at least one electrode (28). Gas flowing across the ring (14) and electrode transmits electrical charges from the electrodes to particles of atomized coating material, downstream from a spray head (6) of the spray device (4). The electrical charging of the coating material is considerably increased thereby.

33 Claims, 4 Drawing Sheets

SPRAY COATING DEVICE FOR ELECTRICALLY CONDUCTIVE COATING LIQUIDS

Figure 1:
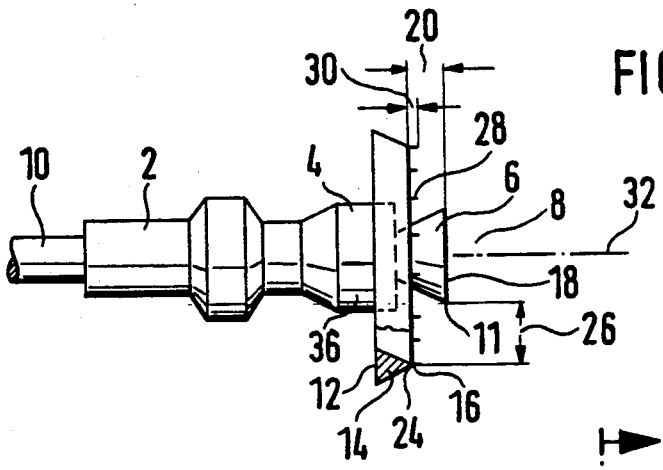

The invention concerns a spray coating apparatus according to the preamble of claim 1.

In a preferred embodiment, the invention concerns a spray coating apparatus for electrically conductive coating liquids. The atomizer is preferably a rotary atomizer.

A spray coating apparatus according to the preamble of claim 1 is previously known from the German patent application M 15 973 IVa/75c. In this device, the electrode arrangement is located completely outside the ring. Both are connected to high voltage.

Electrically conductive coating liquids are specifically enamels containing water or metal particles for so-called metallic finishes. It is customary to electrostatically charge the coating liquid prior to atomization so that it will be electrically attracted by the object being coated, which is grounded. But this involves difficulties in that the electrical voltage is transmitted back into the feed lines through the electrically conductive coating liquid, whereas the storage container for the coating liquid is on ground potential. Therefore, great efforts have already been made toward interrupting the backward electrical current path given through the coating liquid, between the atomizer and the liquid supply system. Devices of this type are known from the German patent disclosure 34 40 381, German patent document 29 37 890 and the British patent document 1,478,853. Reference is also made to: U.S. Pat. No. 3,393,662; German Patent document 3,609,240 Al; German Patent document 3,716,776 Al; U.S. Pat. No. 4,447,008; U.S. Pat. No. 3,049,092; and U.S. Pat. No. 3,408,985.

The problem underlying the invention is to provide a simpler and nonetheless safe method by which a strong electrical charging of possibly all particles of the coating material is generated while at the same time avoiding a voltage back transmission from the sprayed, electrically conductive coating material to the atomizer and into the coating material supply system.

This problem is inventionally solved through the characterizing features of claim 1.

Inventionally, gas flows out the two gas channels transmit electrical charges from the electrode or the electrodes to the atomized coating material only in the spray cloud area. Customarily, the electrical charge transfer from the gas to the coating material takes place in an area in which the atomized coating material particles already have a distance from each other so large that no direct electrical path from the atomized coating material back to the atomizer can occur. The complicated, expensive devices for interruption of the voltage respectively current path in the material supply system of the prior art for electrically conductive coating materials, which again and again needs to be cleaned, becomes unnecessary. This makes the manufacture and the operation of such spray coating devices considerably more inexpensive. Accomplished at the same time, according to the invention, is a more uniform and stronger electrical charging of all particles of the atomized coating material.

The invention is especially advantageous in connection with rotary atomizers which, as is commonly known, have the form of disks, bells or cups and serve the spraying of liquid coating materials. But the invention is not limited thereto; it can be favorably used also with stationary atomizers which, as is known, are of nozzle design and serve the spraying of liquid or powdered coating materials Further characteristics of the invention are contained in the sub-claims.

The invention will be described hereafter with reference to the drawing and with the aid of preferred embodiments, as examples.

Figure 2:
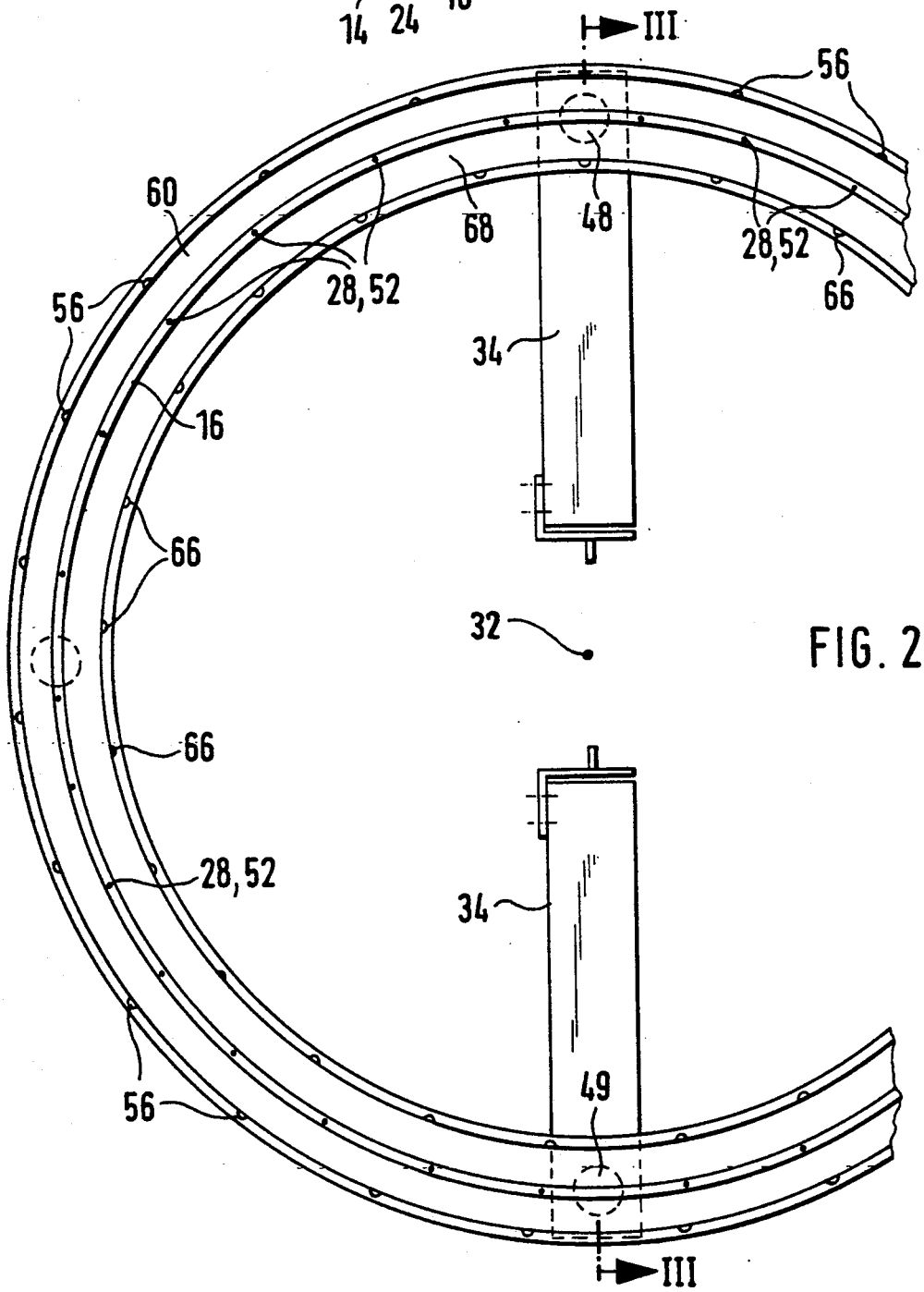
Figure 3:
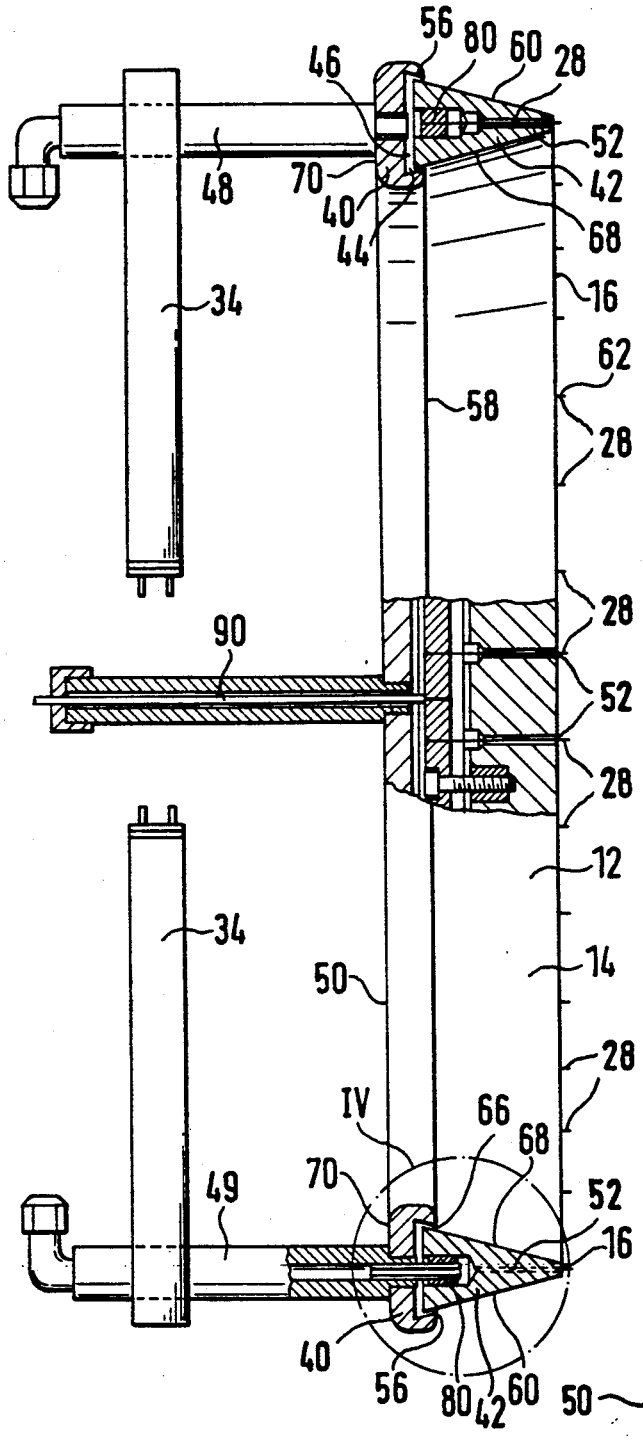
Figure 4:
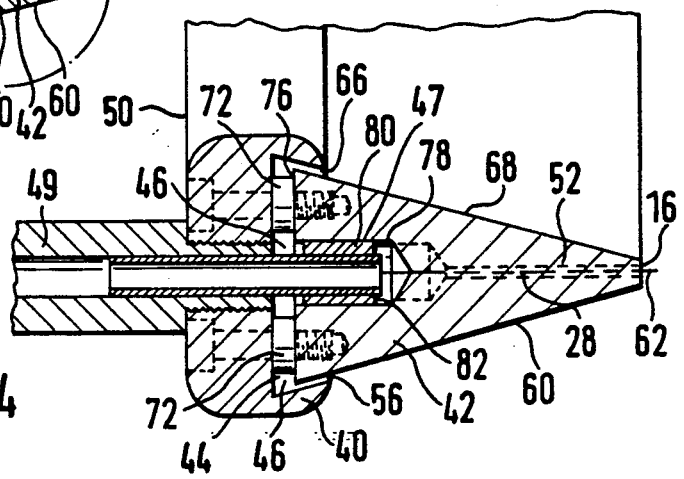
Figure 6:
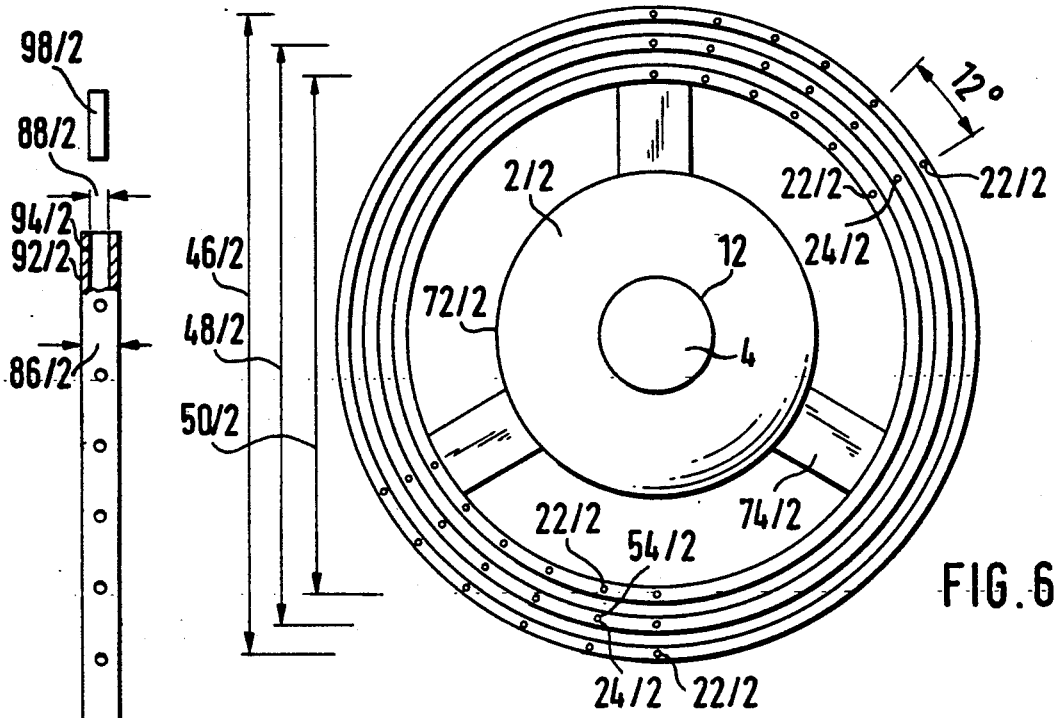
Figure 7:
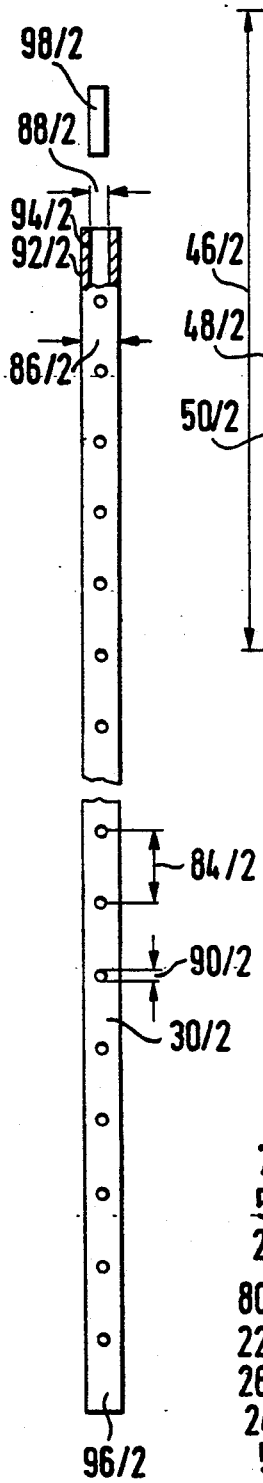
Figure 5:
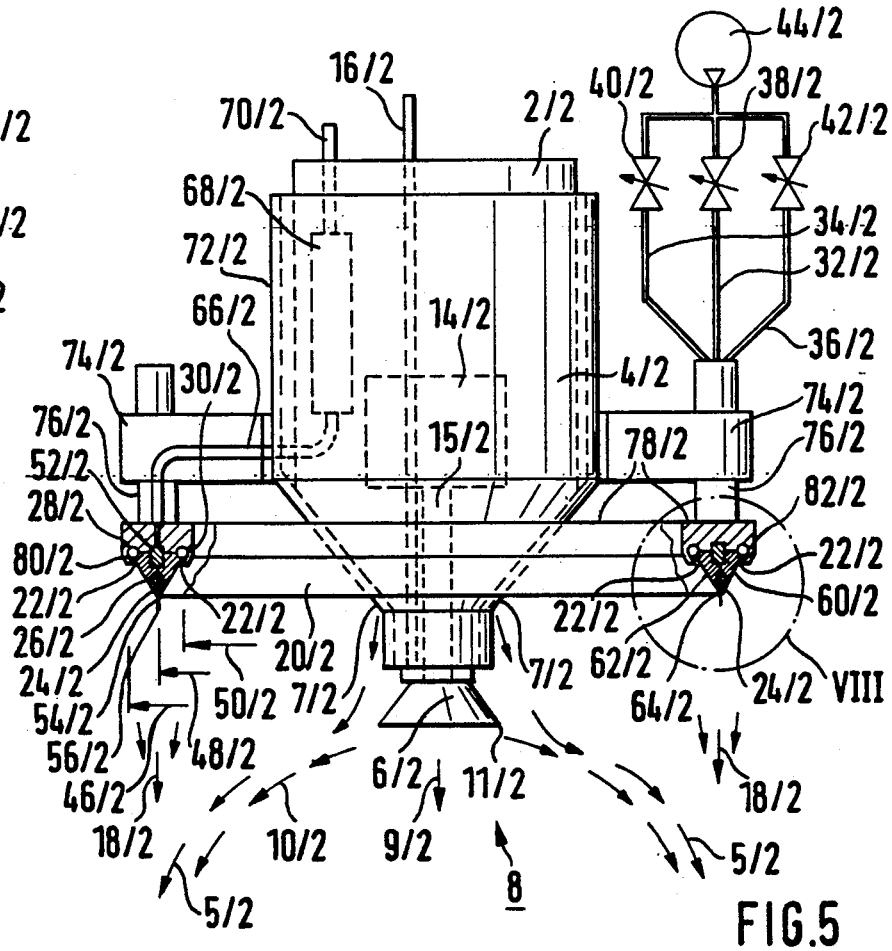
Figure 8:
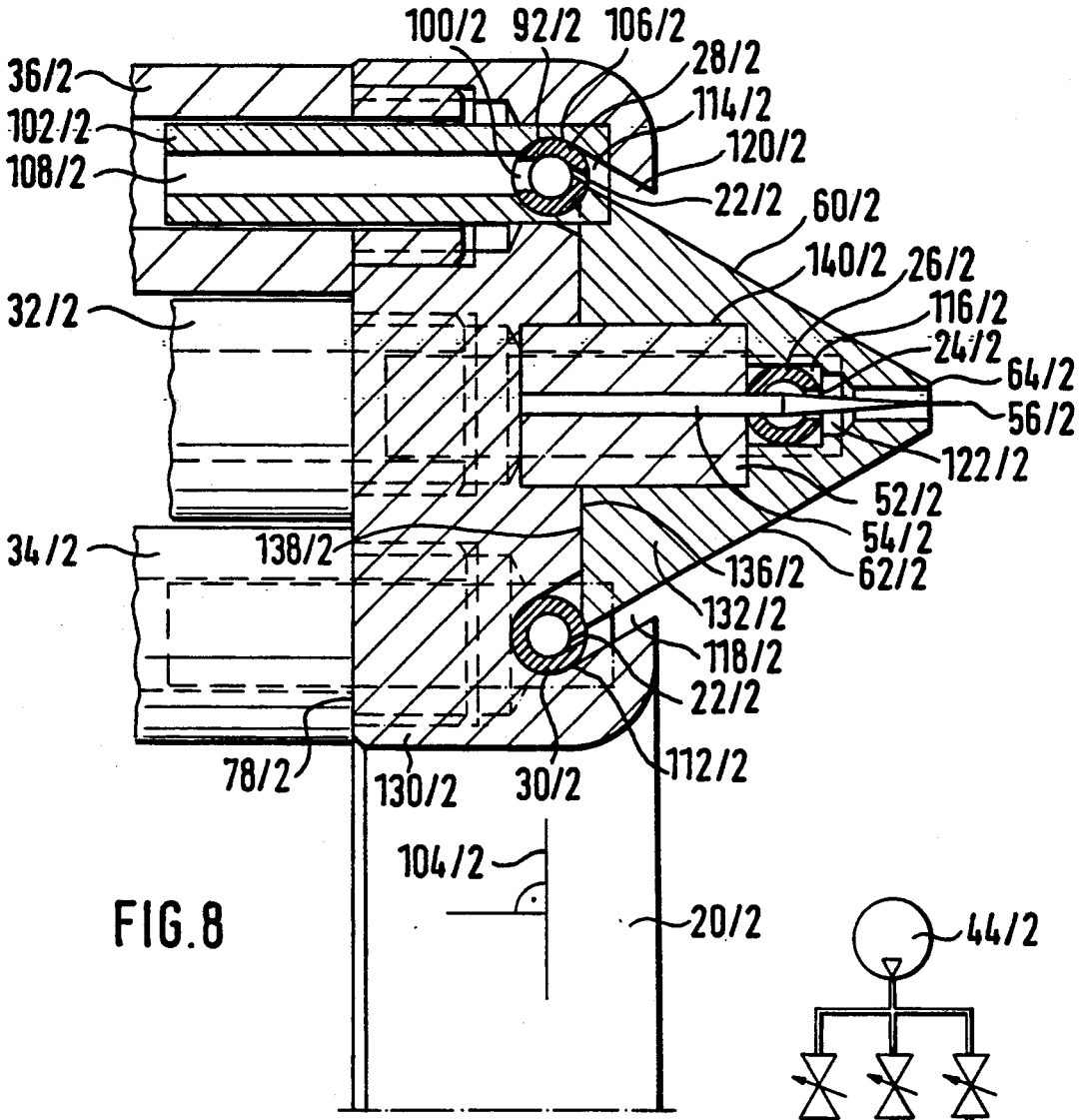
Figure 9:
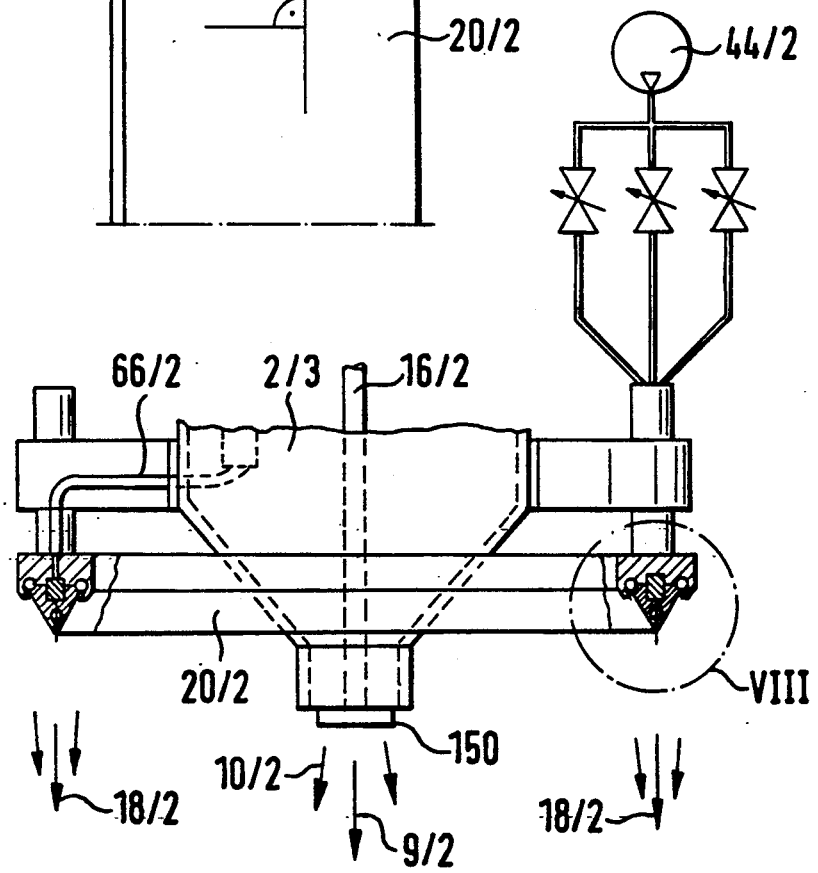

FIG. 1 shows a side elevation of an inventional spray coating apparatus;

FIG. 2, a front view of an electrode arrangement of the spray coating apparatus relative to FIG. 1;

FIG. 3, an axial section of the spray coating apparatus along the plane III—III in FIG. 2;

FIG. 4, scaled up, an illustration of a detail IV in FIG. 3;

FIG. 5, a side view of another embodiment of a spray apparatus according to the invention, partially in section;

FIG. 6, a front view of the apparatus in FIG. 5, viewed from the, bottom relative to FIG. 5;

FIG. 7, a hose according to the invention;

FIG. 8, a section IV of FIG. 5 in axial section;

FIG. 9, yet another embodiment of a spray coating apparatus according to the invention.

The spray coating apparatus 2 illustrated in FIG. 1 through 4, for electrically conductive coating liquids, contains a spray device 4 with a rotary spray head 6 in the form of a rotating bell throwing the coating liquid off an outside edge 11, by rotation, and forming in the spray cloud area 8 located downstream from it a cloud of coating liquid particles which are separated from one another. Connected to this spray coating apparatus 2 is a bundle 10 of several lines for feeding electrically conductive coating liquid from a grounded liquid supply system and for feeding solvent. The solvent serves to pass through the spray coating apparatus, instead of the coating liquid, and clean from it coating liquid before changing over to another type of coating liquid, or at the end of a workday.

An electrode arrangement 12 is supported by a ring 14 from electrically insulating material, which ring concentrically surrounds the spray device 4. The downstream end 16 of the ring 14 has a distance 20 from the downstream end 18 of the rotary body 6, which distance ranges preferably between 0 mm and 50 mm. The radial distance between the outside edge 11 of the rotary body 6 and the radial center 24 on the downstream end of the ring 14 is marked 26 and ranges preferably between 50 mm and 250 mm. A number of electrodes 28 protrude out of the ring 14, on its downstream end 16, by a length 30. The length 30 ranges preferably from 0 mm to 50 mm. The electrodes 28 are arranged around the periphery of the ring 14, on its downstream end 16, at a uniform distribution and extend essentially axially parallel with the axis of rotation 32 of the rotary body 6. The ring 14 connects by way of strips 34 from electrically insulating material with the stationary part 36 of the rotary atomizer 4.

According to FIGS. 2, 3 and 4, the ring 14 consists of two ring-shaped parts, namely a mounting ring 40 and a gas guide ring 42, each made of electrically insulating material. The gas guide ring 42 serves to pass the gas across the electrodes 28 and its outside surfaces in such a way that the gas, preferably air, will receive electrical charges from the electrodes 28 and inject them in the spray cloud area 8, thereby transferring the charges to the atomized, separate particles of the electrically conductive coating liquid.

Formed in the gas guide ring 42, axially parallel with the axis of rotation 32, is a number of first gas channels 52 corresponding to the number of electrodes 28. These each contain one of the electrodes 28, are arranged at a symmetric distribution around the ring-shaped gas guide ring 42 and each extend from an angular groove 47 in the upstream front 76 up to the downstream end 16 of the gas ring 42. The angular groove 47 contains a ring-shaped electrical conductor 80 to which the electrodes 28 are connected and which forms between itself and the bottom of the angular groove 47 a first angular channel 78 that is connected to at least one first gas feed line 49. An electrical high voltage line 90 is connected to the electrical conductor 80. The electrodes 28 are swept by the gas passing through the gas channels 52. The gas guide ring 42 is installed in an angular groove 44 on the downstream side of the mounting ring 40, leaving between both parts a second angular channel 46 which is connected to at least one gas feed line 48 that is located on the upstream side 50 of the ring 14. A second gas channel 56, which may have the shape of an angular slot or be a number of small ring-shaped openings, extends from the angular groove 44 on the downstream side 58 of the mounting ring 40 to a radially outer surface 60 of the gas guide ring 42. The gas flows through the second gas channel 52 from the second angular channel 46 at the radially outer outside surface 60 and across it to the downstream end 16, where the gas flows across the protruding end sections 62 of the electrodes 28 and mixes with the gas from the first gas channels 52. Both gas flows pick up electrical charges from the electrodes 28 and transfer them to the particles of the atomized, electrically conductive coating liquid in the spray cloud area 8. A third gas channel 66, which may have the form of a ring-shaped slot or of openings arranged in ring fashion, extends from the second angular channel 46 down to the downstream side 58 of the mounting ring 40 on the radially inner outside surface 68 of the gas guide ring 42. The gas of this third gas channel 56 flows as well across the protruding end sections 62 of the electrodes 28, mixes with the other gas and transfers together with it electrical charges from the electrodes 28 to the particles of the atomized coating liquid. A high charge of electrical energy is transferred thereby from the electrodes to the particles of the atomized electrically conductive coating liquid, and the outside surfaces 60 and 68 of the gas guide ring 42 are thus kept clean of gas by preventing particles of the coating liquid to proceed on these outside surfaces. The gas prevents a backflow of particles of the coating liquid, upstream from the spray cloud area 8 toward the electrode arrangement 12, so that the outside surfaces 70 of the mounting ring 40 cannot become contaminated either by coating liquid.

As can be seen from FIGS. 3 and 4, the second gas channel 56 and the third channel 66 are formed by a number of small openings between the mounting ring 40 and the gas guide ring 42. Spacers 72 are contained in the angular groove 44 between the mounting ring 40 and the gas guide ring 42.

The separate gas feed lines 49 and 47 enable a separate adjustment and control of the gas supplied to the first gas channels 78, 52 and the second and third gas channels 56 and 66.

The ring 14 has a shape which in a direction downstream from the spray head 6 diminishes cross-sectionally in the form of a wedge, in that the mounting ring has a considerably shorter axial dimension than the gas guide ring 42 and the gas guide ring has in axial section a triangular shape, as can be seen specifically from FIGS. 3 and 4. The outside surfaces 70 of the mounting ring 40 extend into one another in bow fashion, according to FIGS. 3 and 4. The entire cross-sectional shape of the ring 14 is thus aerodynamic in the direction downstream from the spray head 6. The second gas channel 56 extends essentially parallel with the radially outer outside surface 60 while the third gas channel 66 extends essentially parallel with the radially inner outside surface 68 of the gas guide ring 42. These gas channels are very short. The gas discharge direction of the second and third gas channels 56 and 66 is so selected that their gas flows will closely sweep across the outside surfaces 60, 68 of the gas guide ring 42 in the direction toward the downstream end 16.

Illustrated in FIGS. 5 through 9, the further embodiments of the invention produce a uniform volume distribution of the gas issuing out of the angular body, around the atomized coating material while at the same time imparting to the atomized coating material a high electrostatic charge. Avoided at the same time is a contamination of the ring and the electrode arrangement.

A more uniform volume distribution of issuing air around the atomized coating material is obtained in that very small gas outlet openings are formed in a hose or tube from flexible material, for instance by piercing. These gas discharge openings are very much smaller than the inside diameter of the hose or tube. The invention is based on the fact that when gas is introduced in the one end of a very long line there will be no gas proceeding to the other end when small openings are formed in the wall, that the gas will instead issue already at the beginning of the line through the openings in the wall. For purposes of the invention, this is avoided in that the openings in the wall have a diameter which is very much smaller than the inside diameter of the line. The smaller the ratio of the diameter of the gas discharge openings to the inside diameter of the hose, the better is the uniform gas distribution across the entire length of the hose. The outlet openings have preferably a diameter ranging from 0.2 mm to 0.5 mm at an inside diameter of the hose 2.7 mm and 3 mm. This corresponds to a ratio of diameter, or cross-sectional size of the gas outlet openings, to the diameter of the hose of about 0.06 to 0.18. Suitable results are inventionally achieved also when the diameter of the gas outlet openings ranges from 0.1 to 1.0 mm, corresponding to a ratio of the diameter of the gas outlet openings to the inside diameter of the hose of about 0.033 to 0.37.

The device 2/2 illustrated in FIGS. 5 through 8, for electrostatic coating of articles, contains a spray device 4/2 with a rotary spray head 6/2 having the shape of a bell or disk. The rotary spray head 6/2 is driven, e.g., by an air turbine 14/2 with a turbine shaft 15/2 supporting the spray head 6/2. A material feed line 16/2 serves to feed the coating material to the spray head 6/2. The rotary spray head 6/2 throws the coating material off from its outside edge 11/2, essentially radially. This radially thrown off coating material is propelled forward in the direction of arrow 9/2 by a cross-sectionally ring-shaped shaping gas stream 5/2 and is given the shape of a funnel type cone of atomized coating material 10/2. The shaping gas stream 5/2 issues out of a ring-shaped arrangement of openings 7/2 or an annular opening which is formed behind the rotary spray head in the spray device 4/2. Additionally gas jets 18/2 flow from behind into the funnel-shaped coating material 10/2, forming a gas envelope around it. The additional gas jets, preferably air jets, are generated by a ring 20/2 from which they issue through a ring-shaped arrangement of gas discharge openings 22/2 and 24/2 formed in the wall of three hoses 26/2, 28/2 and 30/2 from elastic material. The three hoses 26/2, 28/2 and 30/2 extend along three different annular diameters, each across the entire circumference of the annular body 20/2, and are connected through separate gas feed lines 32/2, 34/2 and 36/2 and pressure adjustment devices 38/2, 40/2 resp. 42/2 to a gas supply, preferably an air compressor 44/2. This makes it possible to adjust the gas pressure for each gas feed line 32/2, 34/2 and 36/2 separately or control it by a computer in contingence on a program. The mean ring diameter 46/2 of the outer hose 48/2 arranged in ring fashion is larger than the mean ring diameter 48/2 of the center hose 26/2 which is arranged in ring-shaped fashion, and the mean ring diameter 50/2 of the hose 30/2 that is arranged in ring-shaped fashion and located radially the farthest outside is smaller than the mean diameter 48/2 of the diametrically medium-sized middle ring 26/2. The three ring-shaped hoses 26/2, 28/2 and 30/2, viewed in longitudinal section, are arranged in the three corners of the, in longitudinal section, essentially triangular ring 20/2, as can be seen from FIG. 4, with the middle ring 26/2 being located forwardly and the two other hoses 28/2 and 30/2 farther to the rear. Arranged in the ring 20/2 is an electrical conductor 52/2 which interconnects a number of needle-shaped electrodes 54/2. The electrodes 54/2 extend through the diametrically medium-sized, forwardly arranged hose 26/2, passing through the gas outlet openings 24/2 of this hose and being spaced closely from the opening rims, so that the electrodes are swept by the gas issuing out of the hose 26/2. In the process, the gas receives electrical charges from the electrodes and transmits them to the atomized coating material 10/2. The electrode points 56/2 protrude a short distance out of the ring 20/2. The gas issuing out of the gas outlet openings 22/2 of the radially inner hose 30/2 and the radially outer hose 28/2 flows across the radially inner and radially outer peripheral surfaces 62/2 and 60/2 of the ring 20/2 which, in spray direction 6/2, converge triangularly essentially in a point, keeping these surfaces clean and mixing then with the gas issuing out of the gas outlet openings 24/2 of the middle ring 26/2, receiving from this gas electrical charges so that electrical charges can increasingly follow from the electrodes 54/2, and the gas causes thereby an increased electrostatic charging of the atomized coating material 10/2. The middle hose 26/2 is located essentially in the point of the triangularly converging outside surfaces 60/2 and 62/2 of the ring 20/2. Due to this pointed shape, a gas flow around the angular body outside surfaces is generated, similar to an airfoil of an airplane, due to which no dirt particles, specifically no coating material, can deposit on the angular body. The ring 20/2 thus has practically no front toward the sprayed coating material, but a gas-swept flow-disrupting edge 64/2 in the area of the electrodes 54/2. The latter are connected through a high-voltage cable 66/2 to the high-voltage side of the voltage generator 68/2, which is an integral part of the spray device 2/2 and can be connected through a low voltage cable 70/2 with a not illustrated low-voltage supply. The spray coating device is surrounded by a housing 72/2 from electrically insulating material. Attached to the housing 72/2 are stays 74/2 which support the ring 20/2. The stays 74/2 are through axially parallel rails 76/2 connected with the third outside surface 78/2 of the cross-sectionally triangular ring 20/2, the other two peripheral surfaces of which are the outside surfaces 60/2 and 62/2. The hoses 28/2 and 30/2 are located in the outer corner 80/2 and the inner corner 82/2 of this triangle.

According to FIG. 6, for instance thirty gas outlet openings 22/2 or 24/2 each are formed around the entire circumference of the ring 20/2 and distributed evenly, in each hose 26/2, 28/2 and 30/2. An electrode 54/2 is located in each of the gas outlet openings 24/2 of the middle ring type hose 26/2. In FIG. 6, not all of the openings 22/2 and 24/2 and electrodes 54/2 are illustrated. But it can be seen that in the preferred embodiment with 30 gas outlet openings 22/2 or 24/2 the outlet openings are arranged at a mutual spacing of 12°. The openings of 22/2 and 24/2 have thus in circumferential direction a spacing 84/2 of approximately 10 mm when the ring 20/2 has an outside diameter of about 465 mm and an inside diameter of about 355 mm. The hose 30/2 which in ring fashion is located inside and the hose 26/2 located in ring fashion in the middle have in the preferred embodiment each an outside diameter 86/2 of 5 mm and an inside diameter 88/2 of 3 mm. The ring-shaped outer hose 28/2 has in the preferred embodiment an outside diameter 86/2 of 4 mm and an inside diameter 88/2 of 2.7 mm. The different inside diameter sizes of the hoses 26/2, 28/2 and 30/2 balance in a simple way different flow resistances which the hoses have on account of their different ring diameters and thus on account of their different length. The diameter 90/2 of the gas outlet openings 22/2 and 24/2 of the hoses 26/2, 28/2 and 30/2 amounts to between 0.1 and 0.8 mm and ranges preferably from 0.2 mm to 0.5 mm. The diameter of the gas outlet openings 24/2 of the middle hose 26/2 is somewhat larger than the diameter of the gas outlet openings 22/2 of the two outer and inner hoses 28/2 and 30/2 because the electrodes 54/2 protrude through these gas outlet openings 24/2 and a small space is required between the opening rims and the electrodes 54/2, through which the gas can issue out of the hose. The outlet openings 22/2 and 24/2 can be formed in a simple way by piercing the wall 92/2 of the hoses with a needle. Another possibility is punching the gas discharge openings. As shown in FIG. 7 with the aid of hose 30/2, the hoses 26/2, 28/2 and 30/2 can be formed from straight hose sections which are bent to a circle and connected at their ends 94/2 and 96/2 by an inserted pin 98/2.

The section IV shown in FIG. 5 is illustrated enlarged in FIG. 8. As can be seen from it, a gas inlet opening 100/2 is formed in the wall 92/2 of each hose, this opening having a diameter which is several times larger than that of the gas outlet openings 22/2 and 24/2. The gas inlet opening 100/2 is connected to a section 102/2 of the gas feed line 32/2 respectively 34/2 respectively 36/2. The gas feed line section 102/2 extends perpendicular to the angular plane 104/2 of the hoses 26/2 28/2 respectively 30/2 that are arranged in ring-shaped fashion. Each of the hoses 26/2, 28/2 and 30/2 extends through a transverse core 106/2 of the gas feed line section 102/2 in such a way that the gas inlet opening 100/2 of the hose is situated in a lengthwise channel 108/2 of the gas feed line section 102/2. The inner hose 30/2 is accommodated in a radially inner angular chamber 112/2, the radially outer hose 28/2 in a mirror-inverted identical outer chamber 114/2, and the middle, forwardly offset hose 26/2 in a middle angular chamber 116/2. A gas outlet 118/2 extends from the inner angular chamber 112/2, level, to the radially inner peripheral surface 62/2 of the angular body 20/2, while a gas outlet 120/2 extends from the radially outer angular chamber 114/2, level, to the radially outer peripheral surface 60/2 of the angular 20/2, and a gas outlet 122/2 extends from the middle angular chamber 116/2 toward the triangular point 64/2 in which the two peripheral surfaces 60/2 and 62/2 converge triangularly. The gas outlet openings 22/2 and 24/2 of the hoses point each in these gas outlets 118/2 respectively 120/2 respectively 122/2. The electrodes 54/2 are fastened on the ring-shaped electrical conductor 52/2 and extend through the middle hose 26/2 up to approximately the triangular point 64/2. The ring 20/2 consists of two major parts, namely an upstream mounting ring 130/2 and, fastened to it, a downstream gas guide ring 132/2. The axial length of the mounting ring 130/2 is considerably shorter than its radial width, so that it has, overall, the shape of a flat ring. The gas guide ring 132/2 has the shape of a triangle with the triangle surfaces 60/2 and 62/2 and a third triangle surface 136/2 that borders on a front surface 138/2 of the mounting ring 130/2. The inner angular chamber 112/2 and the outer angular chamber 114/2 are formed between the two surfaces 136/2 and 138/2 that border on each other, and in the surface 136/2 of the gas guide ring 132 there is provided a ring-shaped recess 140/2 in which the middle angular chamber 116/2 is formed for the middle hose 26/2 and which accommodates the ring-shaped electrical conductor 52/2 with the electrodes 54/2. All of the hoses, electrodes and connections therefor are thus kept between the two parts, mounting ring 130/2 and gas guide ring 132/2. The parts installed in it can be easily and quickly assembled by separating the gas guide ring 132/2 from the mounting 130/2, and there are no fasteners required for the hoses and their connections.

The further embodiment of an inventional spray device 2/3 illustrated in FIG. 9 does not feature a rotary atomizer/spray head but is provided with a stationary spray nozzle 150. All other parts are the same as in the embodiment according to the FIGS. 5 through 8 and, therefore, are not described once more, with the coating material feed line 16/2 emptying in the spray nozzle 150.

In the embodiments according to FIGS. 5 through 9, ring-shaped tubes from plastic or metal, for instance from copper or aluminum, may be used as well instead of the preferred hoses 26/2, 28/2, 30/2.

What is claimed is:

1. An electrode assembly for an atomizer, the atomizer including an atomizer axis along which material dispensed by the atomizer migrates toward an article to be coated thereby, a plane generally perpendicular to the atomizer axis, the location from which material to be atomized by the atomizer is dispensed lying generally in the plane, and the material dispensed by the atomizer being projected generally along the axis in a first direction away from a first side of the plane, the electrode assembly comprising an electrode holder defining a plane curve, a plurality of electrodes, the electrode holder holding the electrodes in spaced orientation to each other, the electrode holder including first and second surfaces inclined toward each other in the first direction toward the plane, means defining first openings therein on a side thereof facing in the first direction from a second side the plane opposite the first side thereof toward the plane, the first openings being spaced along the electrode holder, means providing a second opening or second openings in the electrode holder to direct a second stream or second streams of a gas or mixture of gases at superatmospheric pressure across the first surface, means providing a third opening or third openings in the electrode holder to direct a third stream or third streams of a gas or mixture of gases at superatmospheric pressure across the second surface, the second and third streams of a gas or mixture of gases encountering each other in the vicinity of the first openings, means for fixing the electrodes to the electrode holder with the electrodes extending into the first openings, means for supporting the electrode holder on the second side of the plane adjacent the atomizer with the electrodes extending in the first direction toward the plane and for substantially insulating the electrodes electrically from the atomizer, an electrostatic potential supply, means for coupling the electrodes to the electrostatic potential supply, and the electrode holder including means for feeding a gas or mixture of gases at low superatmospheric pressure to the first openings.

2. The apparatus of claim 1 wherein the atomizer comprises a rotary atomizer and further comprising a motor, means for coupling the rotary atomizer to the motor, operation of the motor causing rotation of the rotary atomizer, and means for feeding material to be atomized to the rotary atomizer, the axis corresponding to the axis of rotation of the atomizer.

3. The apparatus of claim 1 wherein the atomizer comprises a nozzle and means for feeding material to be atomized to the nozzle.

4. The apparatus of claim 3 and further comprising means for feeding a gas or mixture of gases at superatmospheric pressure to the nozzle to aid in atomization of the material.

5. The apparatus of claim 1 wherein the plane curve comprises a closed plane curve.

6. The apparatus of claim 5 wherein the closed plane curve is a circle.

7. The apparatus of claim 1 wherein the electrode holder holds the electrodes in substantially uniformly spaced orientation to each other.

8. The apparatus of claim 1 wherein the atomizer comprises a rotary atomizer and further comprising a motor, means for coupling the rotary atomizer to the motor, operation of the motor causing rotation of the rotary atomizer, and means for feeding material to be atomized to the rotary atomizer, the axis corresponding to the axis of rotation of the atomizer.

9. An electrode assembly for an atomizer, the atomizer including an atomizer axis along which material dispensed by the atomizer migrates toward an article to be coated thereby, a plane generally perpendicular to the atomizer axis, the location from which material to be atomized by the atomizer is dispensed lying generally in the plane, and the material dispensed by the atomizer being projected generally along the axis in a first direction away from a first side of the plane, the electrode assembly comprising an electrode holder defining a plane curve, a plurality of electrodes, the electrode holder including means for holding the electrodes in spaced orientation to each other, means for supporting the electrode holder on the second side of the plane adjacent the atomizer with the electrodes extending in the first direction toward the plane, means for coupling the electrodes to an electrostatic potential supply, means for substantially insulting the electrodes electrically from the atomizer, the electrode holder including first and second surfaces inclined toward each other in the first direction toward the plane, means providing a first opening or first openings in the electrode holder to direct a first streams or first streams of a gas or mixture of gases at superatmospheric pressure across the first surface, means providing a second opening or second openings in the electrode holder to direct a second stream or second streams of a gas or mixture of gases at superatmospheric pressure across the second surface, the first and second streams of a gas or mixture of gases encountering each other in the vicinity of the electrodes.

10. The electrode assembly of claim 9 wherein the means for holding the electrodes in spaced orientation to each other includes means defining a third opening or third openings in a side thereof facing in the first direction from the second side of the plane, and means for fixing the electrodes to the electrode holder with the electrodes extending into the third opening or third openings.

11. The apparatus of claim 10 wherein the atomizer comprises a rotary atomizer and further comprising a motor, means for coupling the rotary atomizer to the motor, operation of the motor causing rotation of the rotary atomizer, and means for feeding material to be atomized to the rotary atomizer, the axis corresponding to the axis of rotation of the atomizer.

12. The apparatus of claim 11 wherein the atomizer comprises a nozzle and means for feeding material to be atomized to the nozzle.

13. The apparatus of claim 11 and further comprising means for feeding a gas or mixture of gases at superatmospheric pressure to the nozzle to aid in atomization of the material.

14. The apparatus of claim 11 wherein the plane curve comprises a closed plane curve.

15. The apparatus of claim 14 wherein the closed plane curve is a circle.

16. The apparatus of claim 10 wherein the electrode holder holds the electrodes in substantially uniformly spaced orientation to each other.

17. The apparatus of claim 9 wherein the atomizer comprises a rotary atomizer and further comprising a motor, means for coupling the rotary atomizer to the motor, operation of the motor causing rotation of the rotary atomizer, and means for feeding material to be atomized to the rotary atomizer, the axis corresponding to the axis of rotation of the atomizer.

18. The apparatus of claim 9 wherein the atomizer comprises a nozzle and means for feeding material to be atomized to the nozzle.

19. The apparatus of claim 18 and further comprising means for feeding a gas or mixture of gases at superatmospheric pressure to the nozzle to aid in atomization of the material.

20. The apparatus of claim 9 wherein the plane curve comprises a closed plane curve.

21. The apparatus of claim 20 wherein the closed plane curve is a circle.

22. The apparatus of claim 9 wherein the electrode holder holds the electrodes in substantially uniformly spaced orientation to each other.

23. Spray coating apparatus with a spray device (4) featuring a spray head (6) which sprays the coating material through a spray cloud area (8) located downstream from it on the article to be coated, with an electroded arrangement (12) surrounding the spray device (4) while radially spaced from it and featuring at least one electrode (28) which is located upstream outside the spray cloud area (8) and serves the electrostatic charging of the atomized coating material, with a ring (14) supporting the electrodes (28), upstream outside the spray cloud area (8), a first gas channel (52, 78) in the ring (14), characterized in that at least a second gas channel (56, 66) is provided which passes the gas across outside surfaces (60, 68) of the ring (14) to its downstream end (16) facing toward the spray cloud area (8) of the atomizer (4), and in that the ring (14) has through the outside surfaces (60, 68) and the downstream end (16) a cross-sectional size which diminishes downstream, due to which the gas of the second gas channel (56, 66) is upon leaving the outside surfaces (60, 68), downstream from the end (16), mixed with the gas from the first gas channel (52) and flows together with this gas into the spray cloud area (8).

24. Spray coating apparatus according to claim 23, characterized in that the electrodes (28) extend through the first gas channel (52) and their downstream ends are located approximately in the gas discharge openings of this first gas channel (52).

25. Spray coating apparatus according to claim 23, characterized in that the electrodes (28) extend through the first gas channel (52) and protrude, downstream, out of the first gas channel (52).

26. Spray coating apparatus according to one of the claims 23 through 25, characterized in that the ring (14) has downstream a shape which cross-sectionally diminishes in wedge fashion.

27. Spray coating apparatus according to claim 26, characterized in that the ring (14), viewed in axial section, has downstream an aerodynamically wedge-shaped form and in that the discharge direction of the second gas channel(s) (56, 66) is so selected that their gas flows closely sweep across the outside surfaces (60, 68) of the ring (14).

28. Spray coating apparatus according to one of the claims 23 through 25, characterized in that the second gas channel (50) empties on a radially outer outside surface (60) and a third gas channel (66) on a radially inner outside surface (68) of the ring (14).

29. Spray coating apparatus according to one of claims 23 through 25, characterized in that all electrodes (28) are connected with one another by a ring-shaped conductor (80) from electrically conductive material.

30. Spray coating apparatus according to one of the claims 23 through 25, characterized in that at least two gas channels (52, 78, 56, 66) are connected to separate gas feed lines (48, 49) through which the gas supplied to these gas channels can be adjusted and controlled separately and independently.

31. Spray coating apparatus according to one of the claims 23 through 25, characterized in that the ring (14) comprises at least two ring-shaped parts (40, 42) in and between which the gas channels (52, 78, 56, 66) and the electrodes (28) are arranged.

32. Spray coating apparatus according to one of the claims 23 through 25, characterized in that at least one of the first and further gas channels (52, 78, 56, 66) is formed by a ring-shaped hose (26/2, 28/2, 30/2) or a ring-shaped tube in which a plurality of discharge openings are formed.

33. Spray coating device according to claim 32, characterized in that the hose (26/2, 28/2, 30/2) or the tube have per gas channel a different inside cross-sectional size.

* * * * *